US005268096A

United States Patent [19]

Robol

[11] Patent Number: 5,268,096

[45] Date of Patent: Dec. 7, 1993

[54] POOL DRAIN ASSEMBLY

[75] Inventor: Ronald B. Robol, Sanford, N.C.

[73] Assignee: Essef Corporation, Chardon, Ohio

[21] Appl. No.: 997,511

[22] Filed: Dec. 28, 1992

[51] Int. Cl.[5] ..... E03F 5/04

[52] U.S. Cl. ..... 210/164; 210/169; 4/507

[58] Field of Search ..... 210/163, 164, 165, 166, 210/169; 4/490, 506, 507

[56] References Cited

U.S. PATENT DOCUMENTS 3,040,895 6/1962 Sisk ..... 210/164

4,561,134 12/1985 Mathews et al. ..... 4/506

*Primary Examiner*—Peter Hruskoci

*Assistant Examiner*—Robert James Popovics

*Attorney, Agent, or Firm*—Pearne, Gordon, McCoy & Granger

[57] ABSTRACT

A pool drain assembly for a swimming pool having a vinyl liner is disclosed. The assembly includes a drainage receptacle which has an upper edge portion substantially at a level defining the bottom of the swimming pool. The receptacle has a conically shaped seating surface, and the vinyl liner covers the surface. A clamping ring is seated on the seating surface and surrounds a strainer plate which also rests on a lower edge of the seating surface. The upper surfaces of the pool liner, the clamping ring, and the strainer plate are all substantially co-planer.

3 Claims, 1 Drawing Sheet

Fig.1
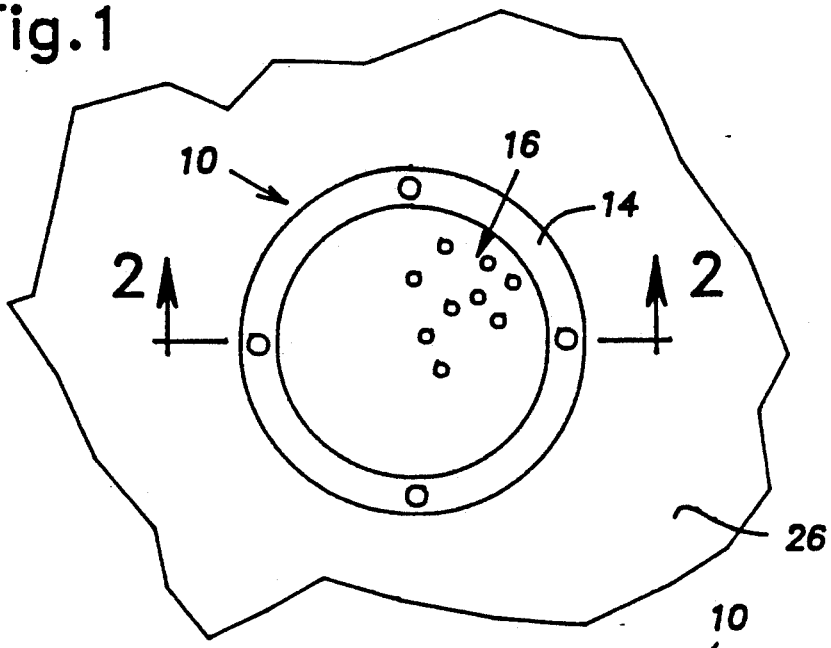
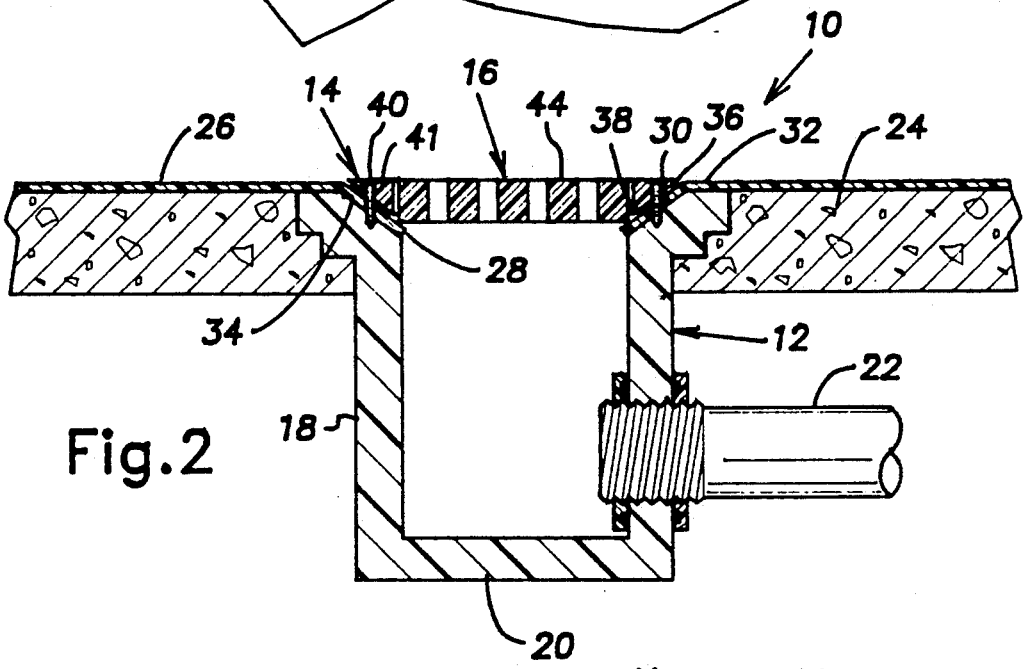
Fig.2
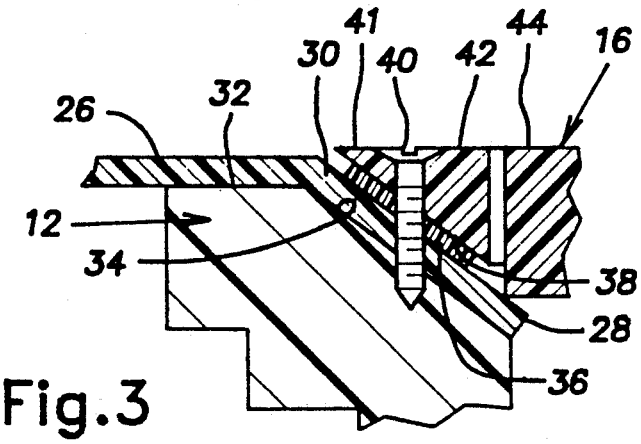
Fig.3

POOL DRAIN ASSEMBLY

BACKGROUND OF THE INVENTION

This invention relates to drainage assemblies and, more particularly, to pool drain assemblies for swimming pools having a vinyl liner.

Vinyl lined swimming pools having drains and other bottom or wall-mounted assemblies, such as skimmers, return fittings and lights include a plastic ring which is attached to the vinyl and into the main drain or other accessory body housing. This plastic ring projects about one-half inch from the vinyl surface. This projection causes problems with respect to silt, leaves and other particles accumulating behind the ridge of the mounting ring. It is difficult to remove this accumulated debris, and the pool bottom tends to remain in an unsightly condition, even though the water may be adequately filtered and treated.

SUMMARY OF THE INVENTION

This invention provides a pool drain assembly for a swimming pool having a vinyl liner which presents a smooth face to the bottom of the pool with no raised edges which might tend to accumulate silt and other debris. According to this invention, the pool drain assembly comprises a drainage receptacle which is recessed into the bottom of the pool and which communicates with the pool drain conduit. The upper edge portion of the receptacle is positioned at a level which substantially coincides with the bottom of the swimming pool, and a conical seating surface slopes downwardly from the edge portion of the receptacle. A vinyl pool liner sheet surrounds the drainage receptacle and has a lip resting on the seating surface. A clamping ring is fixed to the drainage receptacle and sandwiches the lip of the liner against the seating surface. The top surface of the clamping ring is substantially co-planar with the top surface of the vinyl liner which surrounds the lip and has a seating surface which conforms to the conical seating surface. A strainer plate having a top surface substantially co-planar with the top surface of the vinyl liner and the top surface of the clamping ring is provided, and the strainer is surrounded by the clamping ring.

BRIEF DESCRIPTION OF THE DRAWINGS

FIG. 1 is a plan view of the pool drain assembly according to this invention;

FIG. 2 is a cross-sectional view, the plane of the section being indicated by the line 2-2 in FIG. 1; and FIG. 3 is an enlarged fragmentary view of a portion of the assembly.

DETAILED DESCRIPTION OF THE DRAWINGS

Referring now to the drawings, there is illustrated a pool drain assembly 10 which includes a drainage receptacle 12, a clamping ring 14 and a strainer plate 16.

The receptacle 12 is defined by a cylindrical sidewall 18 and a bottom wall 20. A conduit 22 connects the receptacle 14 to the pump and filter assembly for the swimming pool. The receptacle is mounted in the bottom 24 of the swimming pool which is covered by a vinyl sheet 26. The vinyl sheet 26 has an aperture 28 therein which communicates with the receptacle 12 and which defines a lip 30.

The drainage receptacle 12 has an upper edge portion 32 which is substantially at a level defined by the bottom 24 of the swimming pool. A conical seating surface 34 extends from the edge portion 32 toward the bottom 20 of the receptacle. The lip 30 rests on the seating surface and is covered by a conical gasket 36. The clamping ring 14 has a conical wall 38 which mates with the gasket 36 and which securely sandwiches the gasket 36 and the lip 30 against the seating surface 34. Screws 40 are threaded through the clamping ring and into the drainage receptacle to securely hold the assembly in place.

The clamping ring 14 has a top surface 41 which is substantially co-planar with the top surface of the vinyl liner 26, and the clamping ring 14 surrounds the strainer plate 16 With the strainer plate 16 being supported at its lower edge by the seating surface 34. A top surface 44 of the strainer plate 16 is also substantially co-planar with the vinyl liner 26.

Although the preferred embodiments of this invention have been shown and described, it should be understood that various modifications and rearrangements of the parts may be resorted to without departing from the scope of the invention as disclosed and claimed herein.

What is claimed is:

1. A pool drain assembly for a swimming pool having a vinyl liner comprising a drainage receptacle defined by sidewall and bottom wall means, said drainage receptacle having an upper edge portion substantially at a level defining a bottom of a swimming pool, means defining a seating surface extending from said edge portion to said sidewall defining means and toward said bottom wall means, a vinyl liner sheet having means defining an aperture therethrough, said aperture defining means comprising lip means on said seating surface clamping ring means having a triangular cross section and being defined by a conical peripheral surface, a cylindrical inner surface and a planar top surface, said conical peripheral surface being seated on said lip means, said top surface being substantially co-planar with a top surface of said vinyl liner surrounding said lip means, means clamping said ring means to said seating surface to securely sandwich said lip means therebetween, a strainer plate having a top surface substantially co-planar with said top surface of said vinyl liner and said top surface of said clamping ring means, said strainer plate being surrounded by said cylindrical inner surface of said clamping ring means and having a peripheral edge supported by said seating surface.

2. A pool drain assembly according to claim 1, wherein said seating surface is conical.

3. A pool drain assembly according to claim 1, including a conical gasket between said clamping ring means and said lip means.

* * * * *